US011085280B2

(12) United States Patent
Zhang et al.

(10) Patent No.: US 11,085,280 B2
(45) Date of Patent: Aug. 10, 2021

(54) HORIZONTAL WELL MULTI-SECTION MULTI-STAGE RECIPROCATING FRACTURING METHOD AND APPARATUS

(71) Applicant: China University of Petroleum-Beijing, Beijing (CN)

(72) Inventors: Guangqing Zhang, Beijing (CN); Xuelin Zheng, Beijing (CN)

(73) Assignee: CHINA UNIVERSITY OF PETROLEUM-BEIJING, Beijing (CN)

( * ) Notice: Subject to any disclaimer, the term of this patent is extended or adjusted under 35 U.S.C. 154(b) by 29 days.

(21) Appl. No.: 16/711,371

(22) Filed: Dec. 11, 2019

(65) Prior Publication Data

US 2020/0300071 A1 Sep. 24, 2020

(30) Foreign Application Priority Data

Oct. 12, 2018 (CN) ..... 201811188171.6

(51) Int. Cl.
*E21B 43/26* (2006.01)
*E21B 33/12* (2006.01)
(Continued)

(52) U.S. Cl.
CPC ..... *E21B 43/26* (2013.01); *E21B 33/12* (2013.01); *E21B 43/11* (2013.01); *E21B 43/14* (2013.01)

(58) Field of Classification Search
CPC ..... E21B 43/162; E21B 43/26
See application file for complete search history.

(56) References Cited

U.S. PATENT DOCUMENTS 9,016,376 B2 * 4/2015 Surjaatmadja ..... E21B 43/14 166/305.1
9,249,652 B2 * 2/2016 Montgomery ..... E21B 43/26
(Continued)

FOREIGN PATENT DOCUMENTS

CN 105587300 A 5/2015
CN 204877412 U 12/2015
(Continued)

OTHER PUBLICATIONS

First Office Action and search report dated Jul. 17, 2019 for counterpart Chinese patent application No. 201811188171.6, along with machine EN translation downloaded from EPO, 14 pages.

*Primary Examiner* — Kenneth L Thompson
(74) *Attorney, Agent, or Firm* — Loza & Loza, LLP; Michael F. Fedrick

(57) ABSTRACT

The present application provides a horizontal well multi-section multi-stage reciprocating fracturing method and apparatus. The method comprises the steps of: dividing a fracturing tubular column into n fracturing sections; fracturing the first fracturing section to form a first first-stage fracture; fracturing the second fracturing section to form a second first-stage fracture; fracturing the first fracturing section again to form a first second-stage fracture; going on in this way, fracturing the nth fracturing section to form an nth first-stage fracture; fracturing the (n−1)th fracturing section again to form an (n−1)th second-stage fracture; going on in this way, at last, fracturing the nth fracturing section again to form an (n)th-stage fracture. The present method and apparatus can effectively eliminate or reduce the interference of relatively long fractures that has been generated during the horizontal well multi-section fracturing to fractures generated by subsequent fracturing.

10 Claims, 2 Drawing Sheets

(51) Int. Cl.
*E21B 43/11* (2006.01)
*E21B 43/14* (2006.01)

(56) References Cited

U.S. PATENT DOCUMENTS

| | | | | |
|---|---|---|---|---|
| 10,502,033 | B2 * | 12/2019 | Saltel | E21B 43/103 |
| 2018/0245440 | A1 * | 8/2018 | Entchev | E21B 43/162 |
| 2018/0252079 | A1 * | 9/2018 | Stromquist | E21B 43/12 |
| 2020/0024936 | A1 * | 1/2020 | Chang | E21B 34/14 |
| 2020/0362693 | A1 * | 11/2020 | Ahmadian-Tehrani | E21B 47/11 |
| 2021/0032967 | A1 * | 2/2021 | Dusterhoft | E21B 43/26 |

FOREIGN PATENT DOCUMENTS

| | | | |
|---|---|---|---|
| CN | 204877415 | U | 12/2015 |
| CN | 105370259 | A | 3/2016 |
| CN | 106351634 | A | 1/2017 |

* cited by examiner

HORIZONTAL WELL MULTI-SECTION MULTI-STAGE RECIPROCATING FRACTURING METHOD AND APPARATUS

CROSS REFERENCE TO RELATED APPLICATIONS

This application claims the priority of Chinese Patent Application No. 201811188171.6, which was filed on Oct. 12, 2018 and is entitled "Horizontal Well Multi-Section Multi-Stage Reciprocating Fracturing Method and Apparatus." The entire content of the foregoing application is incorporated herein by reference in its entirety.

TECHNICAL FIELD

The present application belongs to the technical field of hydraulic fracturing, which is a means for increasing oil and gas production, and in particular relates to a horizontal well multi-section multi-stage reciprocating fracturing method and apparatus.

BACKGROUND

With the development of China's petroleum industry, the exploitation of low permeability oil and gas reservoirs has gradually increased. Horizontal wells have been increasingly applied to the exploitation of low permeability reservoirs due to a series of advantages, such as strong penetration ability, large oil exposure area, and high degree of reservoir utilization.

Horizontal well sectioned fracturing technology is an important technical measure to increase the production of oil and gas fields in China. Reservoir stimulation by sectioned fracturing can significantly improve the oil and gas seepage conditions around the horizontal well and thereby increase the productivity of the oil and gas well. Under normal circumstances, hydraulic fractures generated after fracturing will appear in a direction perpendicular to the direction of the minimum principal crustal stress. When conventional multi-section fracturing technology is employed for fracturing a horizontal well, a generated relatively long hydraulic fracture will have a certain influence on the surrounding crustal stress field within a certain range. This will change the direction of the minimum principal crustal stress in the stratum around the hydraulic fracture, and thereby influence the result of subsequent hydraulic fracturing. Thus, the hydraulic fractures generated by subsequent fracturing will easily be caused to deviate from the expected fracture trajectory, that is, the subsequent hydraulic fractures will deflect, and consequently the actual hydraulic fractures will deviate greatly from the expected hydraulic fractures.

SUMMARY

To overcome the above deficiencies in the prior art, the present invention intends to solve the technical problem of providing a horizontal well multi-section multi-stage reciprocating fracturing method and apparatus, which can effectively eliminate or reduce the interference of hydraulic fractures that have been generated to hydraulic fractures generated by subsequent fracturing, and can obtain, to the largest extent, a series of straight fractures which are sufficiently long and parallel to one another, such that the range of fracturing stimulation is effectively increased and the reservoir stimulation effect for horizontal wells is improved.

The specific technical solutions of the present invention are as follows.

The present invention provides a horizontal well multi-section multi-stage reciprocating fracturing method, the method comprising the following steps:

obtaining a fracturing tubular column and dividing the fracturing tubular column into n fracturing sections, of which the first fracturing section is farthest away from the wellhead and the nth fracturing section is closest to the wellhead, where n is a positive integer, and $n \geq 2$;

fracturing the stratum where the first fracturing section is located to form a hydraulic fracture of a predetermined length as a first first-stage fracture;

fracturing the stratum where the second fracturing section is located to form a hydraulic fracture of the predetermined length as a second first-stage fracture; fracturing the stratum where the first fracturing section is located again to make the first first-stage fracture extend again for the predetermined length, and stop fracturing, thereby forming a first second-stage fracture;

going on in this way, fracturing the stratum where the nth fracturing section is located to form a hydraulic fracture of the predetermined length as an nth first-stage fracture; fracturing the stratum where the (n−1)th fracturing section is located again to make an (n−1)th first-stage fracture extend again for the predetermined length, and stop fracturing, thereby forming an (n−1)th second-stage fracture; going on in this way, fracturing the stratum where the first fracturing section is located again to make a first (n−1)th-stage fracture extend again for the predetermined length, and stop fracturing, thereby forming a first nth-stage fracture;

fracturing the stratum where the nth fracturing section is located again to make the nth first-stage fracture extend again for the predetermined length, and stop fracturing, thereby forming an nth second-stage fracture; fracturing the stratum where the (n−1)th fracturing section is located to make the (n−1)th second-stage fracture extend again for the predetermined length, and stop fracturing, thereby forming an (n−1)th third-stage fracture; going on in this way, fracturing the stratum where the second fracturing section is located again to make a second (n−1)th-stage fracture extend again for the predetermined length, and stop fracturing, thereby forming a second nth-stage fracture;

going on in this way, at last, fracturing the stratum where the nth fracturing section is located again to make an nth (n−1)th-stage fracture extend again for the predetermined length, and stop fracturing, thereby forming an (n)th-stage fracture.

In a preferred embodiment, the predetermined length does not exceed a half of a distance between adjacent fractures.

In a preferred embodiment, the series of fractures are parallel straight fractures perpendicular to a direction of the minimum principal crustal stress in the original stratum.

In a preferred embodiment, when performing multi-stage reciprocating fracturing for a corresponding fracturing section, the fracturing tubular column of the corresponding fracturing section needs to be perforated.

In a preferred embodiment, first packers are provided over an outside of the fracturing tubular column of the corresponding fracturing section, and a bridge plug is provided inside the fracturing tubular column of the corresponding fracturing section, so as to block the corresponding fracturing section.

In a preferred embodiment, the bridge plug is provided on a side of the corresponding fracturing section which is away from the wellhead.

In a preferred embodiment, second packers are employed to block perforations opened in the rest fracturing sections, which are close to the well head, of the fracturing sections where fracturing is needed.

In addition, the present invention also provides a horizontal well multi-section multi-stage reciprocating fracturing apparatus that adopts the horizontal well multi-section multi-stage reciprocating fracturing method, the apparatus comprising:

a casing tube;

a fracturing tubular column provided within the casing tube, an annulus being formed between the fracturing tubular column and the casing tube, the fracturing tubular column having n fracturing sections and opened with perforations in each section;

two first packers provided in the annulus outside the fracturing tubular column of a corresponding fracturing section, the two packers being disposed respectively on two ends of the corresponding fracturing section;

a bridge plug provided inside the fracturing tubular column of the corresponding fracturing section on a side that is away from the wellhead.

In a preferred embodiment, the apparatus further comprises fracturing trucks and a manifold, the fracturing trucks being connected to the fracturing tubular column by the manifold.

In a preferred embodiment, second packers are provided over an outside of each perforation of all remaining perforations, which are close to the wellhead, of the fracturing sections where fracturing is needed.

By virtue of the above technical solutions, the present application has the following beneficial effects.

The horizontal well multi-section multi-stage reciprocating fracturing method and apparatus of the present invention can effectively eliminate or reduce the interference of relatively long hydraulic fractures that have been generated to hydraulic fractures generated by subsequent fracturing, which occurs in the conventional horizontal well multi-section fracturing process. In this way, the stress interference zone is decreased, and the hydraulic fractures generated by horizontal well multi-section fracturing can be extended perpendicular to a direction of the minimum principal crustal stress of the original stratum, such that a series of straight fractures which are sufficiently long and parallel to one another are obtained. Therefore, the range of reservoir stimulation can be effectively enlarged, and the effect of reservoir stimulation is improved.

Referring to the following description and figures, the specific embodiments of the present application are disclosed in detail, and the modes in which the principle of the present application can be used are clearly pointed out. It should be understood that the embodiments of the present application are not limited thereby in scope. The embodiments of the present application include a lot of alternations, modifications and equivalents within the scope of the spirit and clauses of the appended claims.

Features that are described and/or illustrated with respect to one embodiment may be used in the same way or in a similar way in one or more other embodiments, in combination with or instead of the features of the other embodiments.

It should be emphasized that the term "comprise/contain", when used in this text, is taken to specify the presence of features, integers, steps or components, but does not preclude the presence or addition of one or more other features, integers, steps or components.

BRIEF DESCRIPTION OF THE DRAWINGS

The figures described herein are for explanation purposes only and are not intended to limit the scope of disclosure of the present application in any way. In addition, the shapes, proportions and sizes of the parts in the figures are only schematic to help understanding the present application, and are not provided to specifically define the shapes, proportions and sizes of the parts in the present application. Persons skilled in the art, under the teaching of the present application, can select various possible shapes, proportions and sizes according to the specific situations to implement the present application. In the figures.

Reference signs in the above figures refer to the following: 1. first first-stage fracture; 2. second first-stage fracture; 3. first second-stage fracture; 4. (n−1)th first-stage fracture; 5. second second-stage fracture; 6. first (n−1)th-stage fracture; 7. nth first-stage fracture; 8. (n−1)th second-stage fracture; 9. second (n−1)th fracture; 10. first nth-stage fracture; 11. nth second-stage fracture; 12. (n−1)th (n−1)th-stage fracture; 13. second nth-stage fracture; 14. nth (n−1)th-stage fracture; 15. (n−1)th nth-stage fracture; 16. (n)th-stage fracture; 17. fracturing tubular column; 18. fracturing truck; 19. manifold; 20. annulus; 21. nth fracturing section; 22. (n−1)th fracturing section; 23. second fracturing section; 24. first fracturing section; 25. first packer; 26. bridge plug; 27. stress interference zone

DETAILED DESCRIPTION

The technical solutions in the embodiments of the present application will be clearly and completely described below with reference to the accompanying drawings in the embodiments of the present application. Obviously, the embodiments described herein are only some of the embodiments of the present application rather than all of the embodiments of the present application. Based on the embodiments in the present application, all other embodiments obtained by ordinary skilled persons in the art without paying creative efforts should pertain to the protection scope of the present application.

It should be clearly stated that when an element is referred to as being "provided on" another element, it can be directly on the other element, or an intervening element may also exist. When an element is referred to as being "connected to" another element, it can be directly connected to the other element, or an intervening element may also exist at the same time. The terms "vertical", "horizontal", "left" and "right" as well as other similar expressions used herein are for the purpose of explanation only and do not represent a unique embodiment.

Unless otherwise defined, all technical and scientific terms used in this text have the same meaning as commonly understood by persons skilled in the art to which the present application belongs. The terms used in the Description of the present application are for the purpose of describing the specific embodiments only, and are not intended to limit the present application. The term "and/or" used in this text includes any and all combinations of one or more of the associated listed items.

Figure 1:
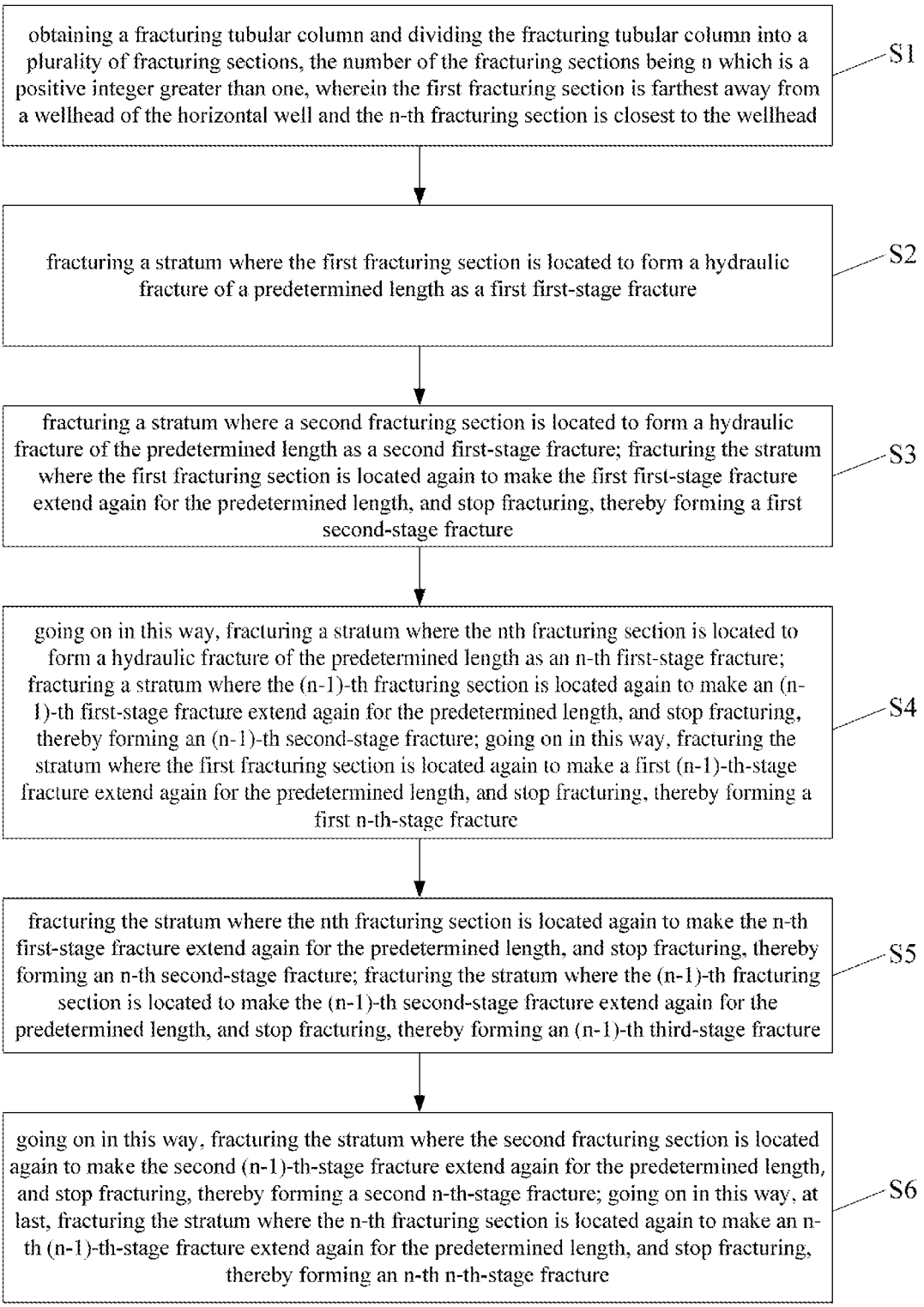
FIG. 1 is a flow chart of a horizontal well multi-section multi-stage reciprocating fracturing method according to the embodiments of the present application.

As shown in FIG. 1, the present invention provides a horizontal well multi-section multi-stage reciprocating fracturing method, which comprises the following steps:

S1: obtaining a fracturing tubular column 17 and dividing the fracturing tubular column 17 into n fracturing sections of which the first fracturing section 24 is farthest away from the wellhead and the nth fracturing section 21 is closest to the wellhead, where n is a positive integer, and n≥2;

S2: fracturing the stratum where the first fracturing section 24 is located to form a hydraulic fracture of a predetermined length as a first first-stage fracture 1;

S3: fracturing the stratum where the second fracturing section 23 is located to form a hydraulic fracture of the predetermined length as a second first-stage fracture 2; fracturing the stratum where the first fracturing section 24 is located again to make the first first-stage fracture 1 extend again for the predetermined length, and stop fracturing, thereby forming a first second-stage fracture 3;

S4: going on in this way, fracturing the stratum where the nth fracturing section 21 is located to form a hydraulic fracture of the predetermined length as an nth first-stage fracture 7; fracturing the stratum where the (n−1)th fracturing section 22 is located again to make an (n−1)th first-stage fracture 4 extend again for the predetermined length, and stop fracturing, thereby forming an (n−1)th second-stage fracture 8; going on in this way, fracturing the stratum where the first fracturing section 24 is located again to make an first (n−1)th-stage fracture 6 extend again for the predetermined length, and stop fracturing, thereby forming a first nth-stage fracture 10;

S5: fracturing the stratum where the nth fracturing section 21 is located to make the nth first-stage fracture 7 extend again for the predetermined length, and stop fracturing, thereby forming an nth second-stage fracture 11; fracturing the stratum where the (n−1)th fracturing section 22 is located to make the (n−1)th second-stage fracture 8 extend again for the predetermined length, and stop fracturing, thereby forming an (n−1)th third-stage fracture; going on in this way, fracturing the stratum where the second fracturing section 23 is located again to make a second (n−1)th-stage fracture 9 extend again for the predetermined length, and stop fracturing, thereby forming a second nth-stage fracture 13;

S6: going on in this way, at last, fracturing the stratum where the nth fracturing section 21 is located again to make an nth (n−1)th-stage fracture 14 extend again for the predetermined length, and stop fracturing, thereby forming an (n)th-stage fracture 16.

In this embodiment, first of all, a fracturing tubular column 17 is obtained and divided into n fracturing sections according to need, of which the first fracturing section 34 is farthest away from the wellhead and the nth fracturing section 21 is closest to the wellhead, where n is a positive integer, and n≥2. Then, fracturing trucks 18 and a manifold 19 can be employed to inject a fracturing fluid into the fracturing tubular column 17 until the fracturing tubular column 17 is filled with the fracturing fluid. After that, a bridge plug 26 and two first packers 25 are employed to block the first fracturing section 24 which is farthest away from the wellhead. The fracturing tubular column 17 of the first fracturing section 24 is perforated to increase the displacement of the fracturing fluid. When the pressure reaches a stratum rupture pressure, the stratum ruptures, forming a hydraulic fracture perpendicular to a direction of the minimum principal crustal stress of the stratum. With the displacement of the fracturing fluid unchanged, the fracture is extended for a predetermined length, and thereafter the fluid injection is stopped, thereby a first first-stage fracture 1 is obtained.

After that, the bridge plug 26 and first packers 25 are transferred to the second fracturing section 23. According to the above fracturing steps, perforating is performed for the second fracturing section 23, and the stratum where the second fracturing section 23 is located is fractured to form a hydraulic fracture of the predetermined length as a second first-stage fracture 2. Then, the bridge plug 26 and first packers 25 are transferred back to the first fracturing section 24. Second packers (not shown) are employed to block the perforation at the position of the perforation in front of the first fracturing section 24 (i.e. the perforation of the second fracturing section 23) from outside the fracturing tubular column 17. After that, the fracturing fluid is continued to be injected for fracturing, whereby the first first-stage fracture 1 is re-opened and extended again for the predetermined length, and thereafter the fluid injection is stopped, thereby a first second-stage fracture 3 is obtained.

Next, the bridge plug 26 and first packers 25 are transferred to the third fracturing section. Perforating is performed for the third fracturing section and the stratum where the third fracturing section is located is fractured to form a hydraulic fracture of the predetermined length as a third first-stage fracture. Then, the bridge plug 26 and first packers 25 are transferred back to the second fracturing section 23. Second packers (not shown) are employed to block the perforation at the position of the perforation in front of the second fracturing section 23 (i.e. the perforation of the third fracturing section) from outside the fracturing tubular column 17. The stratum where the second fracturing section 23 is located is fractured again to make the second first-stage fracture 2 extend again for the predetermined length, and fracturing is stopped, thereby a second second-stage fracture 5 is formed. After that, the bridge plug 26 and first packers 25 are transferred to the first fracturing section 24. Second packers (not shown) are employed to block the perforations at the position of the perforations in front of the first fracturing section 24 (i.e. the perforations of the second fracturing section 23 and the third fracturing section) from outside the fracturing tubular column 17. The stratum where the first fracturing section 24 is located is fractured again to make the first second-stage fracture 3 extend again for the predetermined length, and fracturing is stopped, thereby a first third-stage fracture is formed.

Referring to the above steps and going on in this way, the bridge plug 26 and first packers 25 are transferred to the nth fracturing section 21. Perforating is performed for the nth fracturing section 21, and the stratum where the nth fracturing section 21 is located is fractured to form a hydraulic fracture of the predetermined length as an nth first-stage fracture 7. Then, the bridge plug 26 and first packers 25 are transferred to the (n−1)th fracturing section 22. Second packers are employed to block the perforation at the position of the perforation in front of the (n−1)th fracturing section 22 (the perforation of the nth fracturing section) from outside the fracturing tubular column 17. The stratum where the (n−1) fracturing section 22 is located is fractured again to make the (n−1)th first-stage fracture 4 extend again for the predetermined length, and fracturing is stopped, thereby an (n−1)th second-stage fracture 8 is formed. Going on in this way, the bridge plug 26 and first packers 25 are transferred to the first fracturing section 24. Second packers are employed to block the perforations at the position of the perforations in front of the first fracturing section 24 (i.e. the perforations from the second fracturing section 23 to the nth fracturing section 21) from outside the fracturing tubular column 17. The stratum where the first fracturing section 24 is located is fractured again to make the first (n−1)th-stage fracture 6 extend again for the predetermined length, and fracturing is stopped, thereby a first nth-stage fracture 10 is formed.

The bridge plug 26 and first packers 25 are then transferred to the nth fracturing section 21. The stratum where the nth fracturing section 21 is located is fractured again to make the nth first-stage fracture 7 extend again for the predetermined length, and fracturing is stopped, thereby an nth second-stage fracture 11 is formed. Then, the bridge plug 26 and first packers 25 are transferred to the (n−1)th fracturing section 22. Second packers are employed to block the perforation at the position of the perforation in front of the (n−1)th fracturing section 22 (the perforation of the nth fracturing section 21) from outside the fracturing tubular column 17. The stratum where the (n−1)th fracturing section 22 is located is fractured again to make the (n−1)th second-stage fracture 8 extend again for the predetermined length, and fracturing is stopped, thereby an (n−1)th third-stage fracture is formed. Going on in this way, the bridge plug 26 and first packers 25 are transferred to the second fracturing section 23. Second packers are employed to block the perforations at the position of the perforations in front of the second fracturing section 23 (i.e. the perforations from the third fracturing section to the nth fracturing section 21) from outside the fracturing tubular column 17. The stratum where the second fracturing section 23 is located is fractured again to make the second (n−1)th-stage fracture 9 extend again for the predetermined length, and fracturing is stopped, thereby a second nth-stage fracture 13 is formed.

Going on in this way, at last, the bridge plug 26 and first packers 25 are transferred to the nth fracturing section 21. The stratum where the nth fracturing section 21 is located is fractured again to make the nth (n−1)th-stage fracture 14 extend again for the predetermined length, and fracturing is stopped, thereby an (n)th fracture 16 is formed. Finally, a series of straight fractures which are sufficiently long and parallel to one another are obtained, and fracturing is completed. The present invention can perform multi-section multi-stage reciprocating fracturing for horizontal wells, and can obtain a series of straight fractures which are perpendicular to a direction of the minimum principal crustal stress of the original stratum. These fractures can extend to a sufficient length while remaining parallel with one another. What needs to be explained is that the predetermined length does not exceed a half of a distance between adjacent fractures. In this way, the interference of fractures that has been generated to fractures generated by subsequent fracturing can be effectively eliminated or reduced.

Figure 2:
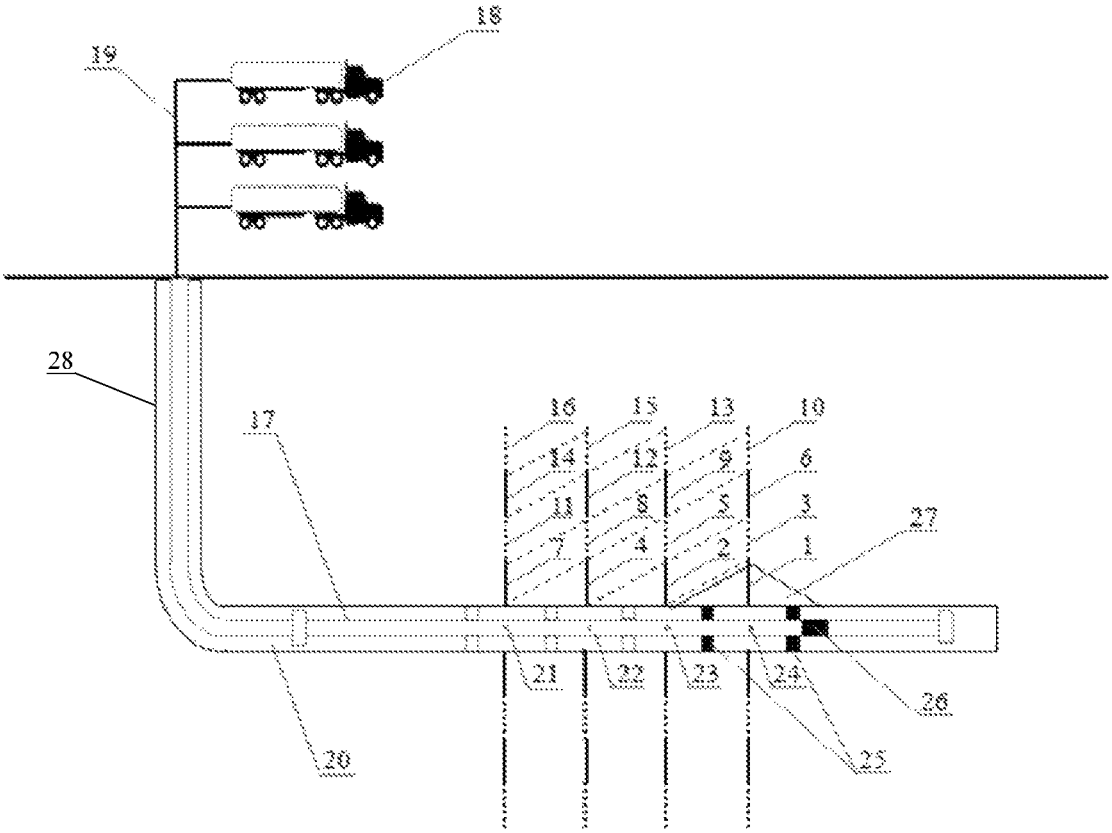
FIG. 2 is a structural diagram of a horizontal well multi-section multi-stage reciprocating fracturing apparatus according to the embodiments of the present application.

In addition, as shown in FIG. 2, the present invention also provides a horizontal well multi-section multi-stage reciprocating fracturing apparatus that adopts the horizontal well multi-section multi-stage reciprocating fracturing method, the apparatus comprising: a casing tube 28, a fracturing tubular column 17, two first packers 25 and a bridge plug 26. The fracturing tubular column 17 is provided within the casing tube 28, an annulus 20 is formed between the fracturing tubular column 17 and the casing tube 28, the fracturing tubular column 17 has n fracturing sections, and each of the fracturing sections is opened with a perforation hole. the two first packers 25 are provided in the annulus 20 outside the fracturing tubular column 17 of a corresponding fracturing section, and are disposed respectively on two ends of the corresponding fracturing section. The bridge plug 26 is provided inside the fracturing tubular column 17 of the corresponding fracturing section on a side that is away from the wellhead.

To be specific, the fracturing tubular column 17 can be provided inside the casing tube 28, and can have n fracturing sections each of which opened with a perforation thereon. The perforations can be formed in sequence according to the actual fracturing need. Since the two first packers 25 and the bridge plug 26 need to assist the fracturing at the corresponding fracturing section, the two first packers 25 need to be provided in the annulus 20 outside the fracturing tubular column 17 of the corresponding fracturing section, and be disposed respectively on two ends of the corresponding fracturing section. The bridge plug 26 needs to be provided inside the fracturing tubular column 17 of the corresponding fracturing section on a side that is away from the wellhead, so as to block the corresponding fracturing section.

If there are perforations on the fracturing tubular column 17 in front of the fracturing section where fracturing is needed (on the fracturing tubular column 17 of the fracturing sections, where fracturing is needed, close to the wellhead), second packers (not shown) can be employed to block the other perforations on the fracturing tubular column 17 in front of the fracturing sections (close to the wellhead) where fracturing is needed, and then fracturing is performed for the corresponding fracturing section. In addition, the apparatus further comprises fracturing trucks 18 and a manifold 19, the fracturing trucks 18 being connected to the fracturing tubular column 17 by the manifold 19, so as to inject the fracturing fluid into the fracturing tubular column 17.

What needs to be explained is that any suitable construction that is available can be used for the first packers 25, the second packers and the bridge plug 26 provided in this embodiment. In order to clearly and briefly explain the technical solution provided in this embodiment, no redundant description of the above parts will be provided here, and the accompanying drawings of the description are simplified accordingly. However, it should be understood that the embodiments of the present application are not limited thereby in scope.

The horizontal well multi-section multi-stage reciprocating fracturing method and apparatus of the present invention can effectively eliminate or reduce the interference of hydraulic fractures that have been generated to hydraulic fractures generated by subsequent fracturing, which occurs in the conventional horizontal well multi-section fracturing technology. In this way, the stress interference zone 27 is decreased, and all the hydraulic fractures generated by horizontal well multi-section fracturing can be extended perpendicular to a direction of the minimum principal crustal stress of the original stratum, such that a series of straight fractures which are sufficiently long and parallel to one another are obtained. Therefore, the range of reservoir stimulation is effectively enlarged, and the effect of reservoir stimulation is improved.

The use of terms "contain" or "comprise" to describe the combination of the elements, components, parts or steps therein also take into account the embodiment substantially constructed by these elements, components, parts or steps. Here, by using the term "can", it is intended to explain that any described attribute that "can" be included is selectable.

Multiple elements, components, parts or steps can be provided by a single integral element, component, part or step. Alternatively, a single integral element, component, part or step can be divided into a plurality of separated elements, components, parts or steps. The terms "a" or "one"

used to describe the elements, components, parts or steps are not intended to exclude other elements, components, parts or steps.

It should be understood that the above description is for graphic illustration rather than limitation. By reading the above description, many embodiments and applications other than the provided examples would be obvious for persons skilled in the art. Therefore, the scope of the teaching should be determined not with reference to the above description, but should instead be determined with reference to the appended claims, along with the full scope of equivalents possessed by the claims. The disclosures of all articles and references, including patent applications and publications, are incorporated herein by reference for purpose of being comprehensive. The omission in the foregoing claims of any aspect of the subject matter that is disclosed herein is not a disclaimer of such subject matter, nor should it be regarded that the inventor did not consider such subject matter to be part of the disclosed inventive subject matter.

What is claimed is:

1. A horizontal well multi-section multi-stage reciprocating fracturing method, comprising the steps of:

obtaining a fracturing tubular column and dividing the fracturing tubular column into a plurality of fracturing sections, the number of the fracturing sections being denoted as n, with n being a positive integer greater than one, wherein the first fracturing section is farthest away from a wellhead of the horizontal well and the n-th fracturing section is closest to the wellhead;

fracturing a stratum where the first fracturing section is located to form a hydraulic fracture of a predetermined length as a first first-stage fracture;

fracturing a stratum where a second fracturing section is located to form a hydraulic fracture of the predetermined length as a second first-stage fracture; fracturing the stratum where the first fracturing section is located again to make the first first-stage fracture extend again for the predetermined length, and stopping fracturing, thereby forming a first second-stage fracture;

fracturing according to this rule, and after fracturing a stratum where the (n−1)-th fracturing section is located and forming an (n−1)-th first-stage fracture with the predetermined length, fracturing a stratum where the nth fracturing section is located to form a hydraulic fracture of the predetermined length as an n-th first-stage fracture; fracturing a stratum where the (n−1)-th fracturing section is located again to make an (n−1)-th first-stage fracture extend again for the predetermined length, and stopping fracturing, thereby forming an (n−1)-th second-stage fracture; fracturing according to this rule, and after fracturing a stratum where the second fracturing section is located and forming a second (n−1)-th-stage fracture with the predetermined length, fracturing the stratum where the first fracturing section is located again to make a first (n−1)-th-stage fracture extend again for the predetermined length, and stopping fracturing, thereby forming a first n-th-stage fracture;

then, fracturing the stratum where the nth fracturing section is located again to make the n-th first-stage fracture extend again for the predetermined length, and stopping fracturing, thereby forming an n-th second-stage fracture; fracturing the stratum where the (n−1)-th fracturing section is located to make the (n−1)-th second-stage fracture extend again for the predetermined length, and stopping fracturing, thereby forming an (n−1)-th third-stage fracture; fracturing according to this rule, and after fracturing a stratum where the third fracturing section is located and forming an third (n−1)-th-stage fracture with the predetermined length, fracturing the stratum where the second fracturing section is located again to make the second (n−1)-th-stage fracture extend again for the predetermined length, and stopping fracturing, thereby forming a second n-th-stage fracture; and fracturing according to this rule, and after fracturing a stratum where the (n−1)-th fracturing section is located and forming an (n−1)-th n-th-stage fracture with the predetermined length, at last, fracturing the stratum where the n-th fracturing section is located again to make an n-th (n−1)-th-stage fracture extend again for the predetermined length, and stopping fracturing, thereby forming an n-th n-th-stage fracture.

2. The horizontal well multi-section multi-stage reciprocating fracturing method according to claim 1, wherein, the predetermined length does not exceed a half of a distance between adjacent fractures.

3. The horizontal well multi-section multi-stage reciprocating fracturing method according to claim 1, wherein, all of the fractures are parallel straight fractures perpendicular to a direction of a minimum principal crustal stress in an original stratum where the fracturing tubular column is located.

4. The horizontal well multi-section multi-stage reciprocating fracturing method according to claim 1, wherein, when performing multi-stage reciprocating fracturing for a fracturing section, the fracturing section has been perforated in advance.

5. The horizontal well multi-section multi-stage reciprocating fracturing method according to claim 4, wherein, first packers are provided over an outside of the fracturing section on which multi-stage reciprocating fracturing is being performed, and a bridge plug is provided inside the fracturing section, so as to block the fracturing section.

6. The horizontal well multi-section multi-stage reciprocating fracturing method according to claim 5, wherein, the bridge plug is provided on a side of the fracturing section on which multi-stage reciprocating fracturing is being performed which is away from the wellhead.

7. The horizontal well multi-section multi-stage reciprocating fracturing method according to claim 4, wherein, second packers are employed to block perforations opened in fracturing sections which are closer to the well head than the fracturing sections where fracturing is being performed.

8. A horizontal well multi-section multi-stage reciprocating fracturing apparatus for use in the horizontal well multi-section multi-stage reciprocating fracturing method according to claim 1, the apparatus comprising:

a casing tube;

a fracturing tubular column provided within the casing tube, an annulus being formed between the fracturing tubular column and the casing tube, the fracturing tubular column having a plurality of fracturing sections and opened with perforations in each of the fracturing sections;

two first packers provided in the annulus outside the fracturing tubular column of a corresponding fracturing section, the two packers being disposed respectively on two ends of the corresponding fracturing section; and a bridge plug provided inside the fracturing tubular column of the corresponding fracturing section on a side that is away from the wellhead.

9. The horizontal well multi-section multi-stage reciprocating fracturing apparatus according to claim 8, wherein, the apparatus further comprises: fracturing trucks and a manifold, the fracturing trucks being connected to the fracturing tubular column by the manifold.

10. The horizontal well multi-section multi-stage reciprocating fracturing apparatus according to claim 8, wherein, second packers are provided over an outside of each of the perforations which are closer to the wellhead than a perforation of the fracturing section where fracturing is being performed.

* * * * *